US008783489B2

(12) United States Patent
Bellehumeur et al.

(10) Patent No.: US 8,783,489 B2
(45) **Date of Patent: *Jul. 22, 2014**

(54) COLLAPSIBLE STORAGE CONTAINER

(75) Inventors: Alexander R. Bellehumeur, Long Beach, CA (US); James Woods, Tustin, CA (US)

(73) Assignee: Alex Bellehumeur, Long Beach, CA (US), Trustee of the Alex Bellehumeur Family Trust ( * ) Notice: Subject to any disclaimer, the term of this patent is extended or adjusted under 35 U.S.C. 154(b) by 0 days.

This patent is subject to a terminal disclaimer.

(21) Appl. No.: 13/371,805

(22) Filed: Feb. 13, 2012

(65) Prior Publication Data

US 2012/0138604 A1 Jun. 7, 2012

Related U.S. Application Data

(63) Continuation of application No. 11/792,161, filed as application No. PCT/US2006/049366 on Dec. 27, 2006, now Pat. No. 8,113,372.

(60) Provisional application No. 60/756,342, filed on Jan. 5, 2006, provisional application No. 60/831,273, filed on Jul. 17, 2006.

(51) Int. Cl.

| | |
|---|---|
| ***B65D 6/16*** | (2006.01) |
| ***B65D 6/18*** | (2006.01) |
| *B65D 21/08* | (2006.01) |
| *B65D 88/52* | (2006.01) |

(52) U.S. Cl.

CPC ..... *B65D 11/184* (2013.01); *B65D 11/1813* (2013.01); *B65D 11/18* (2013.01); *B65D 21/086* (2013.01); *B65D 88/52* (2013.01)

USPC ..... 220/7; 220/666; 220/9.2; 220/1.5

(58) Field of Classification Search

CPC .... B65D 11/18; B65D 11/1846; B65D 21/00; B65D 11/1826; B65D 11/184; B65D 11/1853; B65D 11/1813; B65D 21/086; B65D 88/00; B65D 88/52

USPC ..... 220/6, 7, 666, 9.2, 9.3, 1.5; 217/12 R, 217/13, 43 R, 8, 45; 206/218, 600; 248/346.3; 294/81.5, 81.51, 81.52, 294/81.53, 81.1, 81.4, 81.41, 81.56, 81.6, 294/81.61, 81.62

See application file for complete search history.

(56) References Cited

U.S. PATENT DOCUMENTS

| | | | |
|---|---|---|---|
| 3,518,046 | A | 6/1970 | Cicirello |
| 3,568,608 | A | 3/1971 | Taylor |

(Continued)

FOREIGN PATENT DOCUMENTS

| | | |
|---|---|---|
| GB | 539390 | 9/1941 |

OTHER PUBLICATIONS

International Search Report issued Jan. 9, 2008, pp. 1-3.

*Primary Examiner* — Robert J Hicks
*Assistant Examiner* — Kareen Rush
(74) *Attorney, Agent, or Firm* — Fulwider Patton LLP

(57) ABSTRACT

A collapsible cargo container is disclosed wherein end walls are pivoted into the container when empty and locked against the roof, and then side walls buckle via hinges into a folded configuration. The folded configuration is achieved easily with a modified spreader without the need to otherwise disassemble or deconstruct the container, leaving no loose parts or tools. The cargo container preferably constructed with an improved light weight panel that facilitates loading of the container while improving strength and reducing weight.

4 Claims, 21 Drawing Sheets

(56) References Cited

U.S. PATENT DOCUMENTS

| | | | | |
|---|---|---|---|---|
| 4,214,669 | A | 7/1980 | McQuiston | |
| 4,848,618 | A | 7/1989 | Yuan et al. | |
| 5,292,432 | A | 3/1994 | Jainek et al. | |
| 5,624,149 | A | 4/1997 | Tokarz | |
| 5,653,491 | A | 8/1997 | Steffens et al. | |
| 5,715,636 | A | 2/1998 | Taylor | |
| 6,068,324 | A | 5/2000 | DeKlotz | |
| 6,827,231 | B2 | 12/2004 | Budowski et al. | |
| 7,870,970 | B2 | 1/2011 | Fisk | |
| 8,113,372 | B2 * | 2/2012 | Bellehumeur et al. | 220/7 |
| 8,196,766 | B2 * | 6/2012 | Schrayvogel | 220/7 |
| 8,469,215 | B2 * | 6/2013 | Giesbers | 220/1.5 |
| 8,480,552 | B2 * | 7/2013 | Chawla et al. | 493/409 |
| 2007/0039954 | A1 | 2/2007 | Wang et al. | |

* cited by examiner

COLLAPSIBLE STORAGE CONTAINER

CROSS-REFERENCES TO RELATED APPLICATIONS

This application is a Continuation application that claims the benefit of National Stage application Ser. No. 11/792,161, now U.S. Pat. No. 8,113,372, which in turn claims the priority of PCT/US06/49366, filed on Dec. 27, 2006 which claims the priority from U.S. Provisional Patent Application Ser. No. 60/756,342 filed on Jan. 5, 2006 and U.S. Provisional Patent Application Ser. No. 60/831,273 filed on Jul. 17, 2006, the contents of which are fully incorporated herein by reference.

BACKGROUND

The shipping industry employs the use of large cargo containers to transport cargo to be shipped from one location to another. These containers can be easily and conveniently loaded and unloaded, and moved from one transport vehicle or vessel to another for transport across land and/or sea. These containers eliminate the historical requirement to manually transfer cargo from vessel to vessel and from vehicle to vehicle during its course of being transported from one place to another.

The cargo containers in use today have become standardized in dimension and structural, and are such that they can be easily, conveniently and securely stacked vertical in a side by side and end to end relationship to maximize the use of hold and deck space on ships and the like, on which such containers are placed. Trailers are standardized to carry the containers for delivery by trucks and the like.

The principal shortcoming found in the use of cargo containers of the character referred to above resides in the fact that day to day commerce can require that these containers be transported empty from a station or site of delivery of cargo to a next site or station for receipt or loading of cargo. Such transporting of empty containers is non-profitable since each such container occupies valuable and costly space on the ship that could otherwise accommodate a loaded or filled container. Further, the handling and shipping of both loaded and empty containers creates a multitude of other problems. One such problem resides in arranging light, empty containers and heavy, loaded containers aboard ships in such a manner that the ships are properly and safely trimmed.

When transporting a high percentage of empty containers, the voyage of such ships is uneconomical and must be made up somewhere along the way with increased costs of goods and shipping. Accordingly, large economic savings in shipping by containers could be realized if empty containers could be folded or collapsed so that they occupy a fraction of the space they occupy when in their expanded configuration. For example, if two containers when collapsed could occupy the space of one container in its normal configuration, the cost of shipping empty collapsed containers would be roughly reduced about one-half.

The prior art has proposed a number of nesting cargo container structures intended to effectively reduce the space required for their shipment when they are empty. While certain proposed nesting containers might well serve such an end, it is understood that they are seriously wanting in certain material respects. For example, a shortcoming found in space saving cargo containers proposed by the prior art includes the deconstruction of the container with the resultant burden of removable or separable parts which are subject to being misplaced, lost, damaged and/or stolen. Experience has taught that if parts of equipment such as cargo containers can be removed and lost or readily damaged, such parts will be removed, lost and/or damaged in the normal course of their use and that great difficulties and inconveniences will be experienced in maintaining such containers.

The construction of traditional cargo containers are made to comply with ISO standard 1496-1, which specifies dimensional and strength requirements but not construction methods. Cranes provided assistance for handling some loads and the advent of the fork lift truck led to the introduction of palletized loads which avoided handling of individual items when transferring between different types of transport at freight terminals. Palletized loads still offered limitations in relation to the speed of handling and especially in relation to their stacking capacity. This has led to development and widespread adoption of containers.

Various sizes have now become standardized 20' (6 m) long containers are the most common. The width has become standardized at 2438 mm. Containers can be loaded at the source and are easily transferred between different types of transport e.g. road, rail or ship. Forklift trucks can be used to load a container with palletized loads. Pallets are approximately 48"×40" (1200-1000 mm) square. Ten pallet places can be accommodated in a standard container. Large ocean going vessels have been designed for handling the containers which can be stacked one on top of the other perhaps as many as seven high. Containers have the advantage of offering protection to the contents within. There is a constant flow of containers around the globe to meet the requirements for the supply of raw materials and products. To maximize container utilization it is desirable to be able to fill a container whenever it is moved from one location to another, but it has been calculated that 20% of containers are transported empty on re-positioning runs.

Typical "40-foot" container construction consists of 8 industry-standard corner fittings arranged in space at the corners of a generally 8' wide by 8'6" high by 40' long rectangular box. Various tubes and channels formed from steel sheet are welded between the corner fittings. Steel sheets are welded between these tubes and channels, forming the roof, side walls and front wall. These sheets are typically corrugated to impart sufficient rigidity to the sheet to allow the walls to be made from a single sheet of steel. Door leaves are installed in place of a rear wall and allow cargo to be loaded and unloaded, while the floor is typically made from wood mounted atop a welded grid of steel channels. FIG. 1 shows the construction of the side wall of a typical container. The corner fittings (1) are located at the corners of each wall. A portion of the wall has been removed to reveal the corrugation of the steel sheet (2), which is welded to front corner post (3), rear corner post (4), upper rail (5), and lower rail (6). This method of construction also generally applies to the opposite side wall, the front wall and also to the roof. The door leaves are typically constructed similarly, less corner fittings.

The result of this method of construction is that the interior and exterior faces of the walls are not flat and smooth. The heavy corrugations of the interior walls often make loading and unloading of cargo difficult as the forks and tires of the forklift get hung up on the corrugations while maneuvering. This is particularly troublesome where loads are balanced on pallets and the uneven surfaces can also cause spilling of the loads, sometimes requiring special lifting equipment to restack the pallets. There is a need in the art for a container that has more even surfaces that resist interference with forklift tires, forks, and the like.

Yet another shortcoming found in collapsible containers proposed by the prior art is the lack of structural features which enable or facilitate the folding down and setting up or opening of such containers in a simple and effective manner.

SUMMARY OF THE INVENTION

This document describes a new type of dry cargo container used for shipping freight over land and sea. Generally, the invention is a special configuration of container which allows it to collapse, saving space when not in use. Containers in current use are made to comply with ISO standard 1496-1 and are not collapsible. The new container is designed to comply with the external dimensional requirements of the ISO standard for containers of 20-foot length and above, but differs in other respects. Loaded containers are lifted from above using an apparatus called a spreader. The folding container described herein can be handled with standard spreaders, and can also be folded and unfolded using a special new spreader specifically designed for the purpose.

The cargo container described herein may take many different forms, but is characterized in that the ends of the container secure to the ceiling of the container, allowing the side walls collapse onto the floor to greatly reduce the height of the container while maintaining the same footprint. The preferred mechanisms by which the container folds and collapses is described in detail in the section below.

BRIEF DESCRIPTION OF THE DRAWINGS

For a better understanding of the present invention together with other and further objects, advantages and capabilities thereof, reference is made to the following disclosure and appended claims in connection with the above described drawings directed to an improved shipping container.

FIG. 16 is a perspective view of a modified spreader adapted for rotating the door frame and front wall against the upper wall and for collapsing the side walls of the container;

DETAILED DESCRIPTION OF THE PREFERRED EMBODIMENTS

Figure 1:
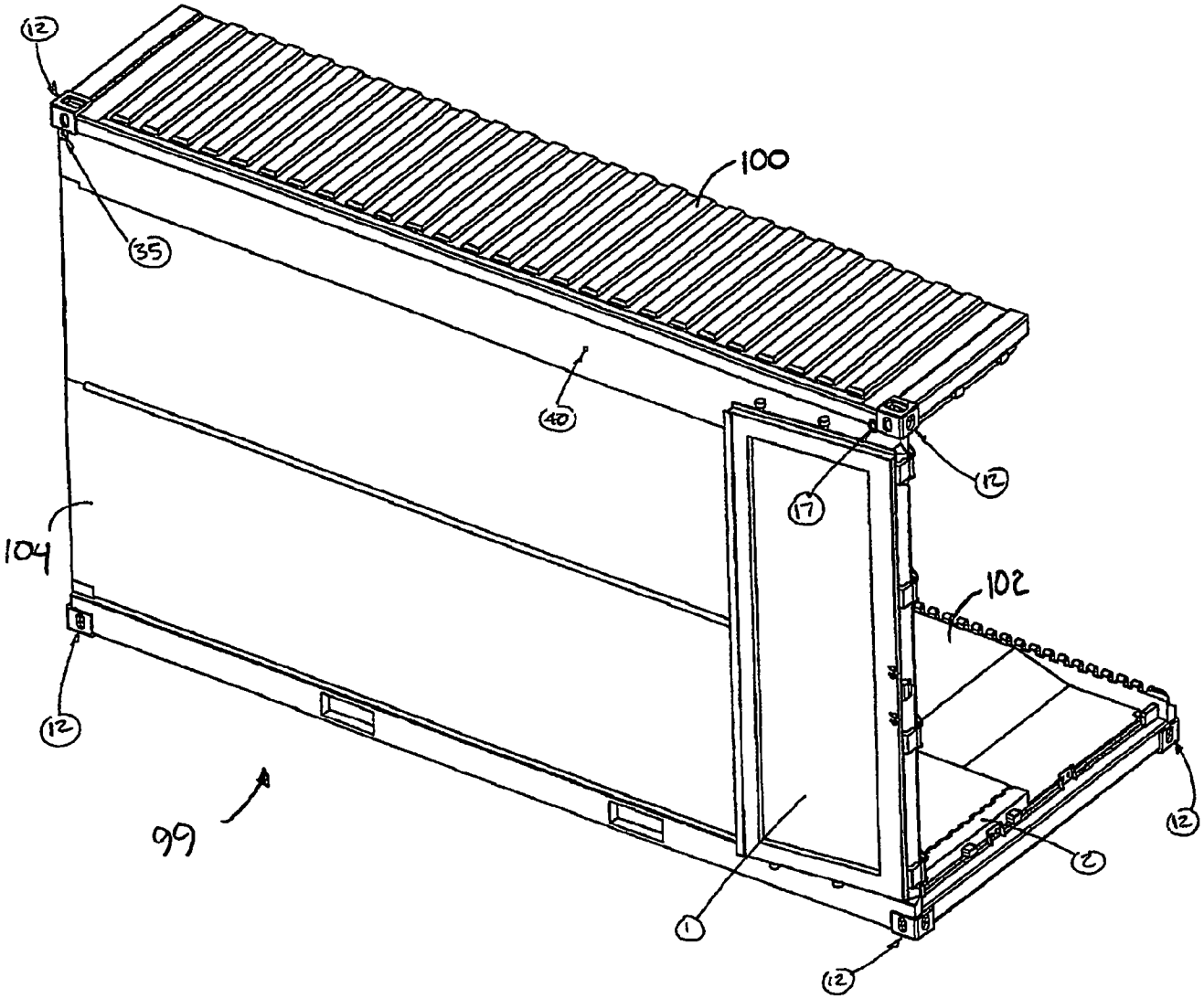
FIG. 1 is a perspective view of a preferred embodiment of a shipping container of the present invention with portions of the container removed for clarity.

FIG. 1 shows a first preferred embodiment of the shipping container 99 of the present invention in its fully expanded state. Portions of the right half of the container are omitted to better show the container's interior. The container is formed of a corrugated upper wall 100, a substantially smooth floor 102, a front wall 30, first and second rear doors leaves 1, and collapsible left and right walls 104. The left-hand door leaf 1 is shown fully open, ready to load and unload cargo. The right hand door leaf is omitted for clarity but would operate similarly to the left hand door leaf. At each vertex of the adjoining walls are corner fittings 12 that cooperate with a spreader to lift and transfer the container 99. Stacked containers 99 generally only contact each other at the corner fittings 12, resulting in tremendous compressive loads carried between vertical pairs of corner fittings 12. Loaded containers are lifted from above using a spreader 16 which locks into the upper corner fittings 12. The weight of the container when carried by the spreader imparts a large tensile load between vertical pairs of corner fittings.

Figure 2:
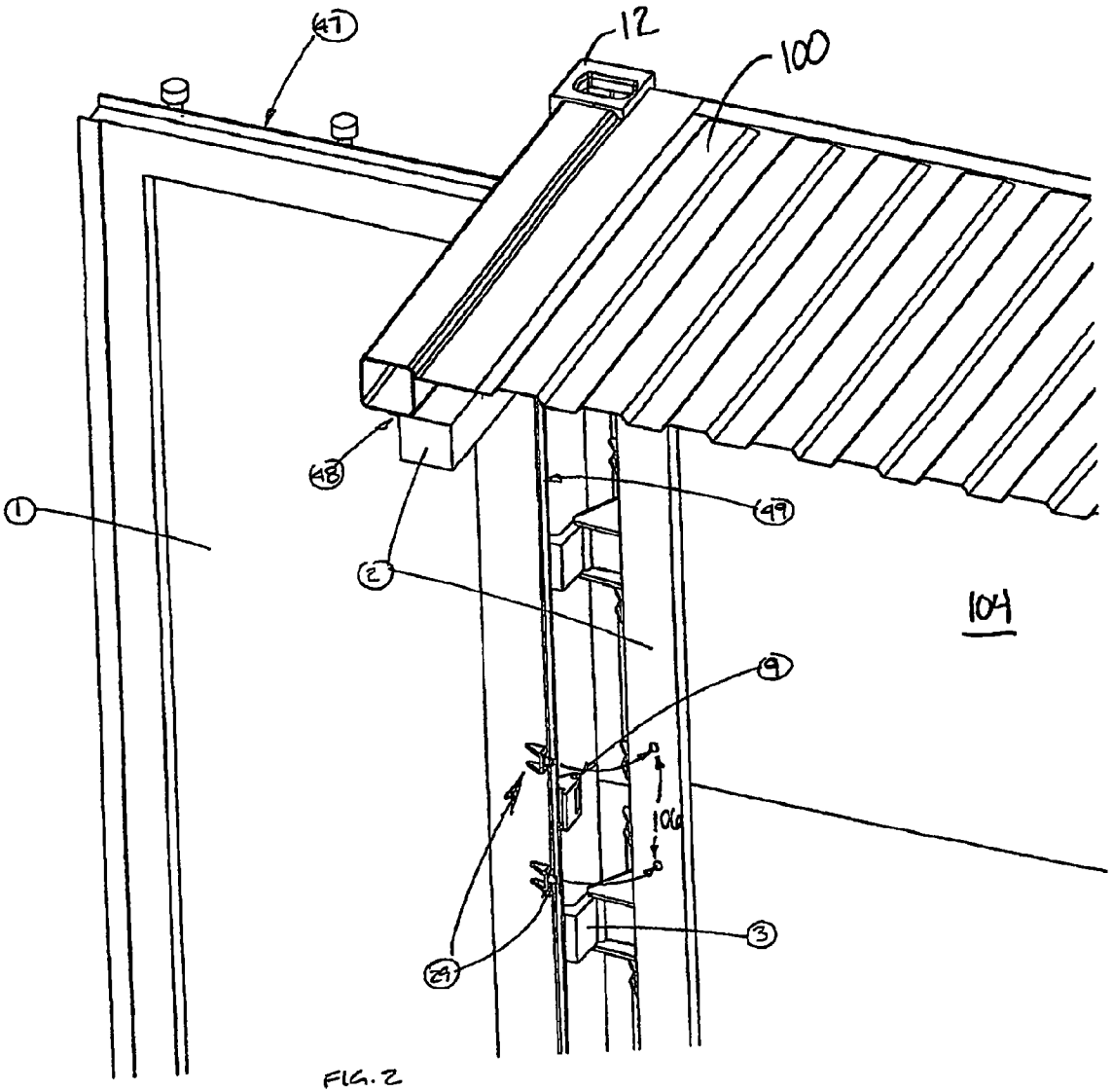
FIG. 2 is an enlarged, elevated perspective view of the juncture of the side wall, upper wall, and door juncture of the embodiment of FIG. 1.

FIG. 2 is a close-up view of the inside of the left door 1 where the door 1 is ajar. The door 1 is attached to a door aperture frame 2 via door hinges 3. The door aperture frame 2 can be a weldment roughly forming a square defining the opening of the container 99 at the rear opening. The door hinges 3 are dog-legged shape which allows them to wrap around the side walls 104 when the door 1 is fully open, yet remain fully inboard of the side wall 104 when the door 1 is closed. Door leaf side pins 29 mounted on the door are disengaged from their corresponding holes 106 in the door aperture frame. The pins 29 when engaged with their respective holes increase the burst strength of the door leaves, and also to help to keep the lashing assembly 9 engaged with the door aperture frame 2. Compression seals 49 along the periphery of the door seals out moisture and contaminants, as do mating seals 47, 48.

Figure 3:
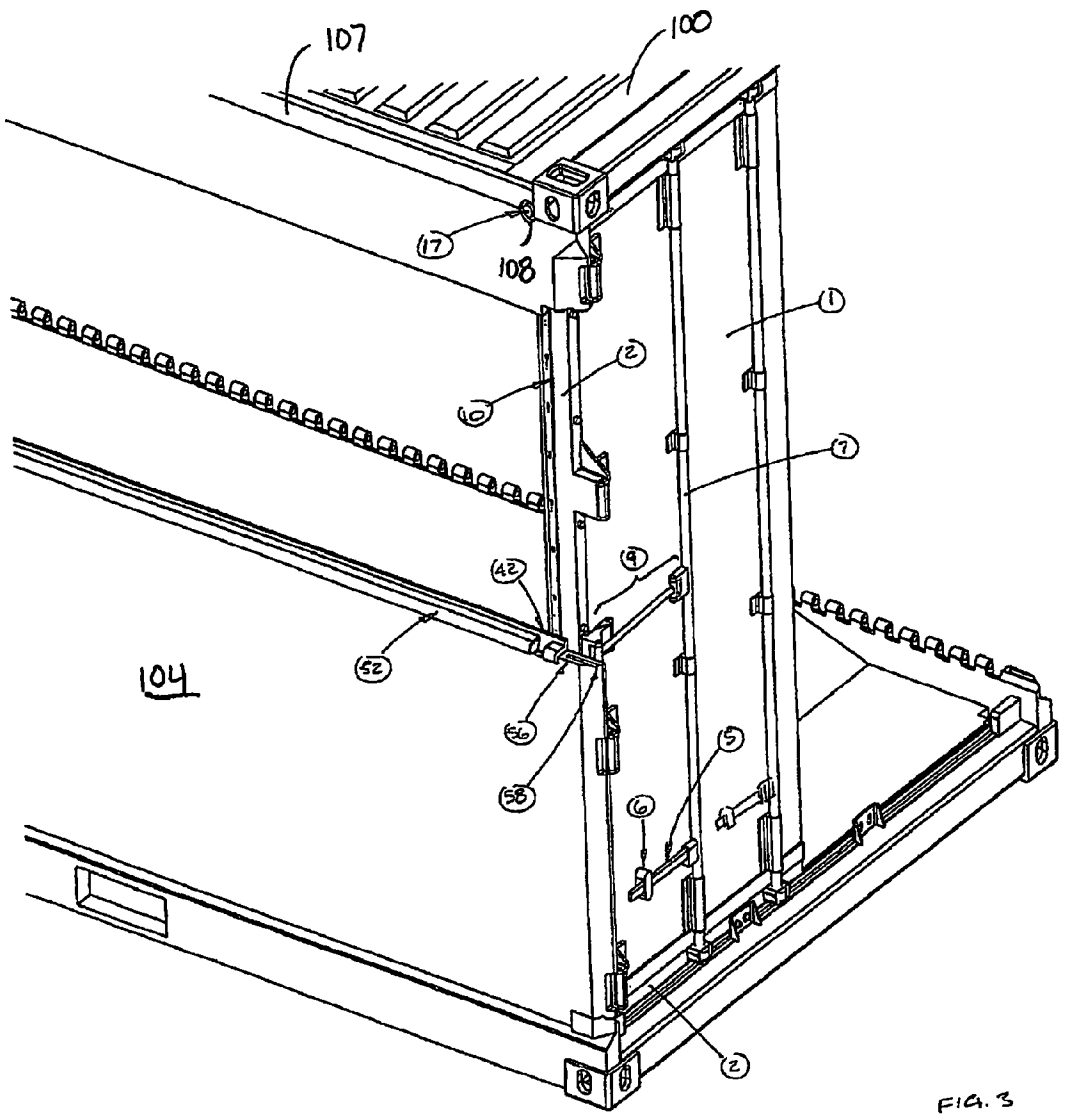
FIG. 3 is an elevated perspective view of the side wall with an outer panel removed to show a hinge assembly, and door assembly of FIG. 1.

FIG. 3 shows the left-hand door 1 in the fully closed position. In this position, the door 1 can be locked to the door aperture frame 2 by turning the door leaf locking lever 5 toward the stay 6, causing the rod 7 to rotate and the door lock 8 to lock. Lashing assembly 9 is also operated by the lever 5, and serves to tie the outboard edges of the door 1 to the door aperture frame 2 by causing a tab on the lashing assembly to rotate into a slot in the door aperture frame 2. Several of these assemblies 9 may be required on each door leaf. The upper panel of the side wall 104 is not shown, revealing the rub strip 10 affixed along the vertical length of the door aperture frame.

The purpose of the rub strip 10 is to reduce abrasion of the inboard faces of the side walls as the container is folded. Hinge pin 17 of the door aperture frame 2 is exposed via a hole 108 in the lateral edge 107 of the upper wall 100. Hinge pin 17 is integrally formed with the door aperture frame 2, and serves as a lifting pin.

The hinge 52 of side wall 104 includes a longitudinal axis that lies on, or slightly outboard of, the outer face of the side wall 104, allowing the upper and lower portions of the side walls to rotate 180 degrees relative to each other. Compressive loads created when containers are stacked are primarily communicated through columns built into the fore and aft ends of the side walls 104. These columns are vertical when the container is in the expanded, or unfolded state, and make contact with each other at compression faces 56 as observed with the upper side wall removed. Compression faces mate in pairs, with one face having an alignment groove 58 and the other face having as alignment tab 57 (see FIGS. 18 and 20), which cooperate to maintain the intended alignment.

Figure 4:
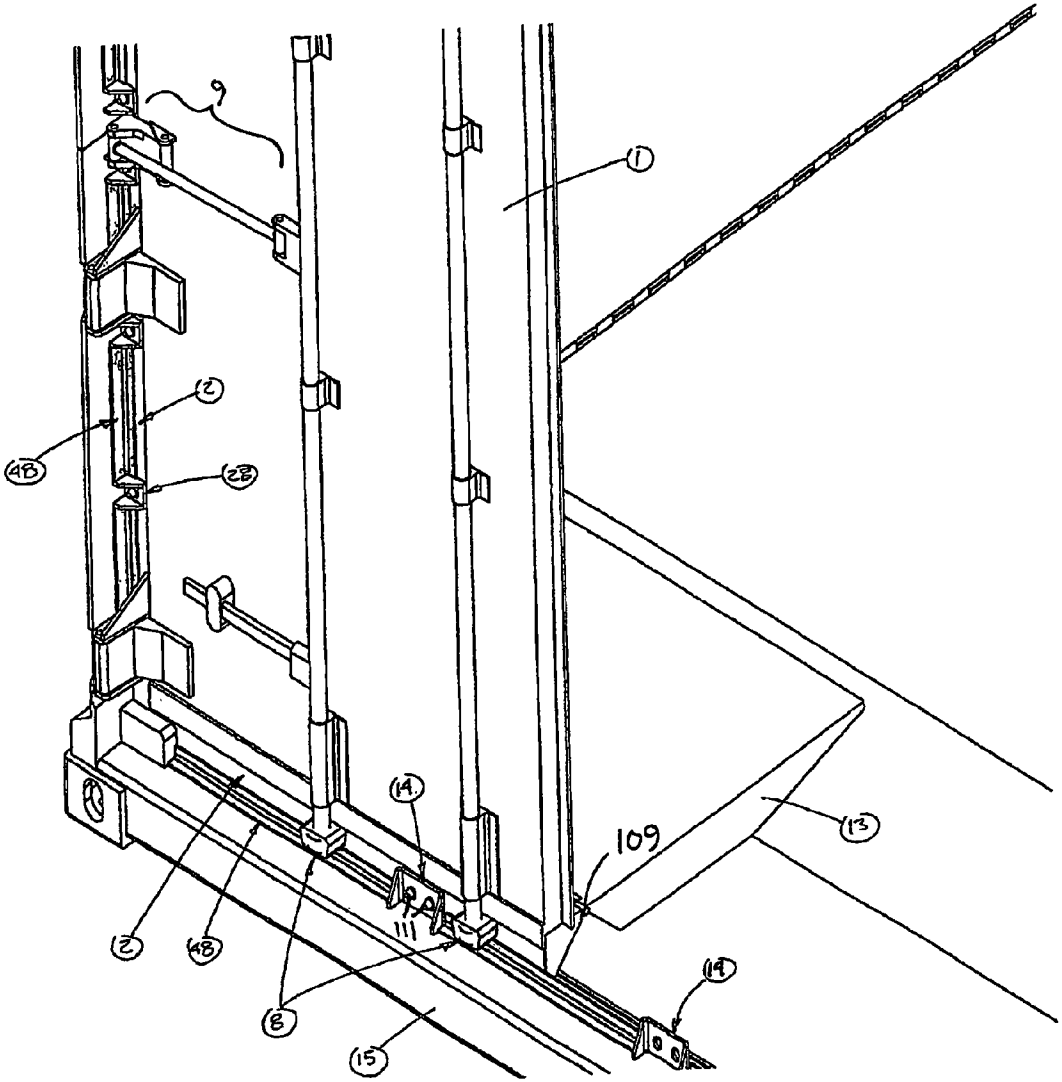
FIG. 4 is an elevated perspective view of the door assembly of FIG. 1.
Figure 5:
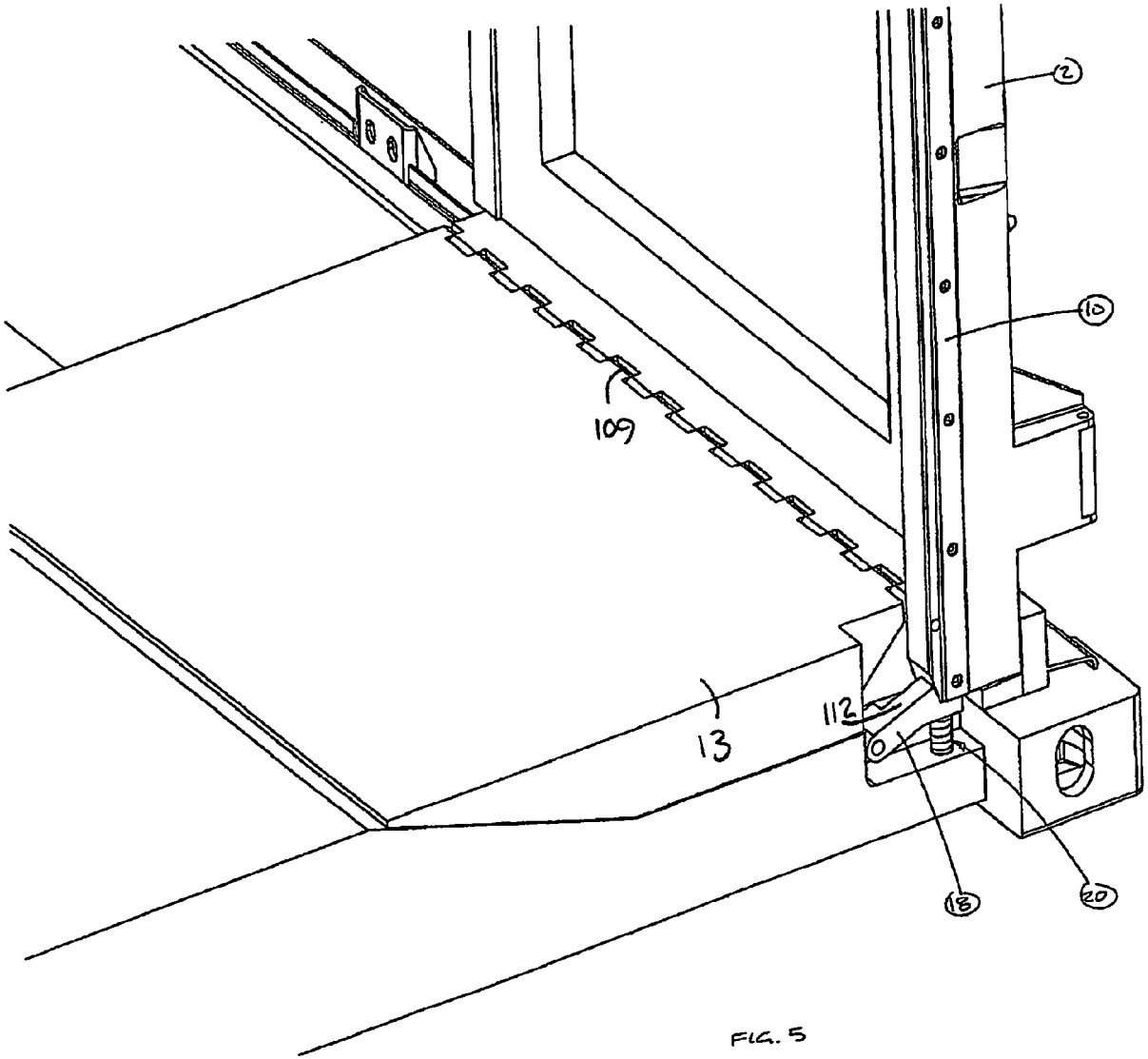
FIG. 5 is an enlarged, elevated perspective view of the down locks and connection of the door frame of FIG. 1.

FIGS. 4 and 5 show a ramp 13 (sectioned for clarity) at the opening to the rear entry. The ramp 13 is attached across the lower edge of the door aperture frame 2 via a continuous hinge 109. The ramp acts as a temporary floor section that can be moved out of the way of the door aperture frame 2 as it is rotated into the roof. Down stops 14 which limit the travel of the door aperture frame are shown attached to the door sill 15. The down stops 14 are slotted to receive pins 111 which are integral with the door aperture frame 2. When engaged, these pins 111 help to support the floor by fastening the door sill 15, via the down stops 14, to the door aperture frame 2, which is in turn fastened to the door 1 via the door locks 8.

FIG. 5 shows one version of a down lock 18, which keeps the door aperture frame 2 locked in place when the container 99 is fully unfolded. Portions of the floor assembly is not shown in FIG. 5 for clarity. A spring 20 biases the down lock 18 toward the upward position. The spring 20, as well as the inclined upper face 112 of the down lock 118, allow the door aperture frame 2 to push the down lock 18 out of the way during the unfolding operation so that the door aperture frame 2 can move to its lower rest position shown in FIG. 5. The lock 18 springs up again once the door aperture frame 2 has passed, locking the door aperture frame into place. When the container 99 needs to be collapsed, a pin that is part of the spreader apparatus 16 pushes down on a rod within the vertical member of the door aperture frame (2), pushing the down lock 18 downward to allow the door aperture frame 2 to pass over the inclined upper face 112 in the opposite direction. A similar mechanism would be used for the front wall 30 at the opposite end of the container 99. Other variations of the down lock 18, such as a spring loaded pawl or a spring loaded bolt, will work well to secure the door aperture frame 2.

Figure 6:
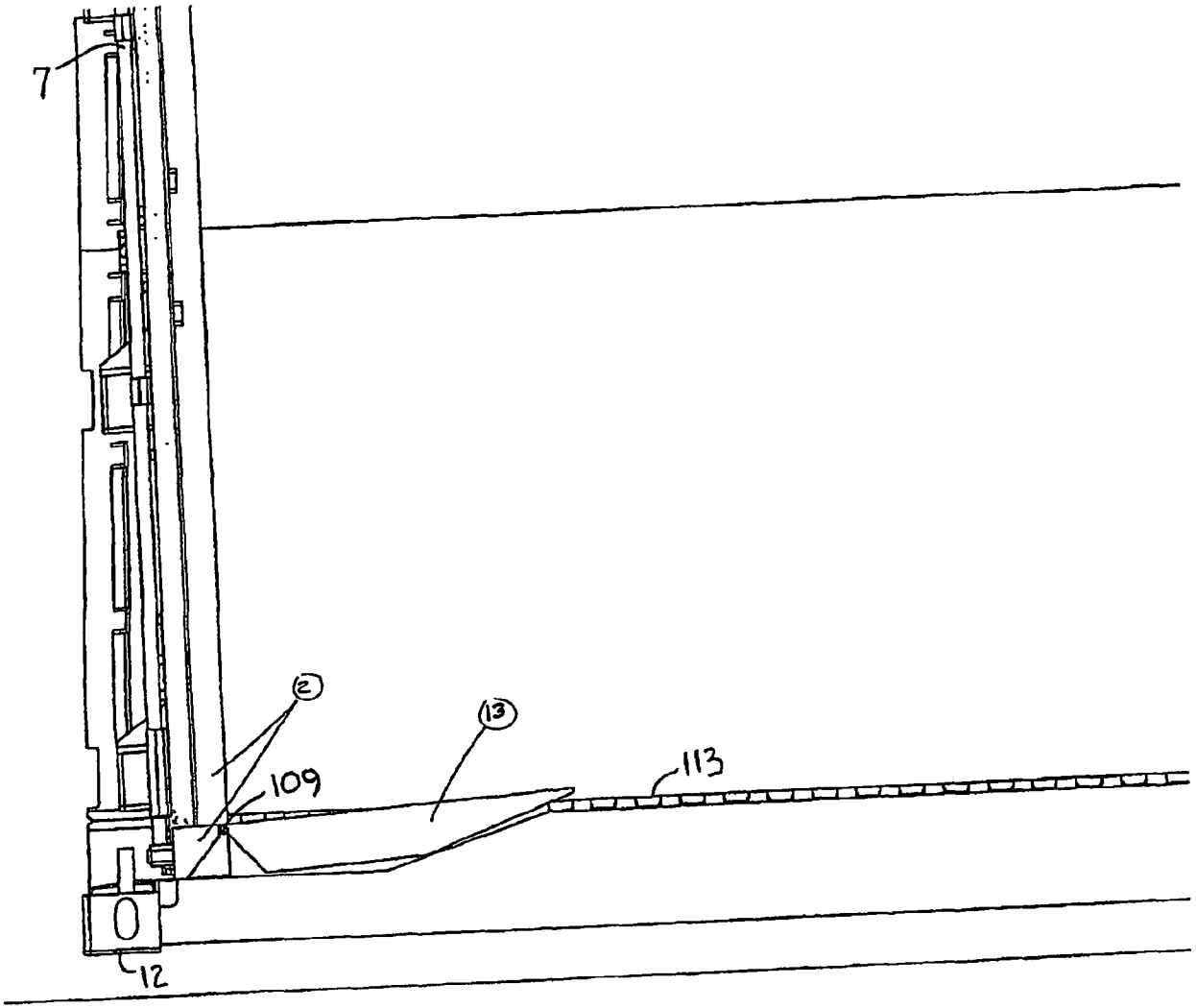
FIG. 6 is a cut-away side view of the ramp assembly as the door frame begins to swing upward toward the upper wall.
Figure 7:
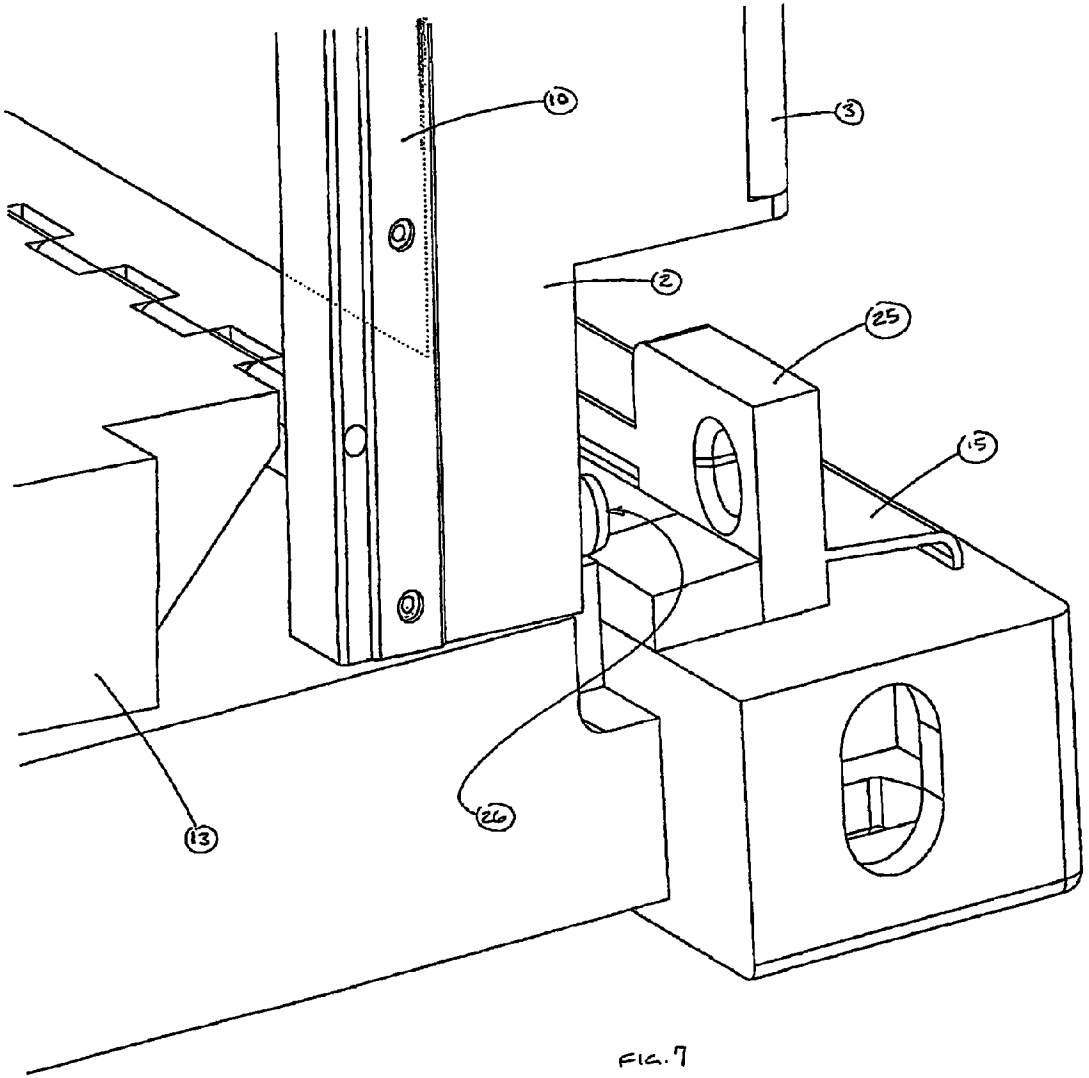
FIG. 7 is an enlarged, elevated perspective view of the door frame and lifting pins, lugs.

FIG. 6 shows the door aperture frame 2 after the down locks 18 have been released, being pushed into the roof assembly as the container 99 is being folded. The ramp 13 is designed as a wedge so that it lifts itself out of the recess in the floor 113. FIG. 7 shows door aperture frame 2 in the same position, but from a different angle, revealing the lifting lug 25 and lifting pin 26. The lifting pin 26 is integral with the door aperture frame 2, and along with door aperture frame hinge pin 17, forms a path for tensile lifting loads between vertical pairs of corner fittings at the back end of the container.

Figure 8:
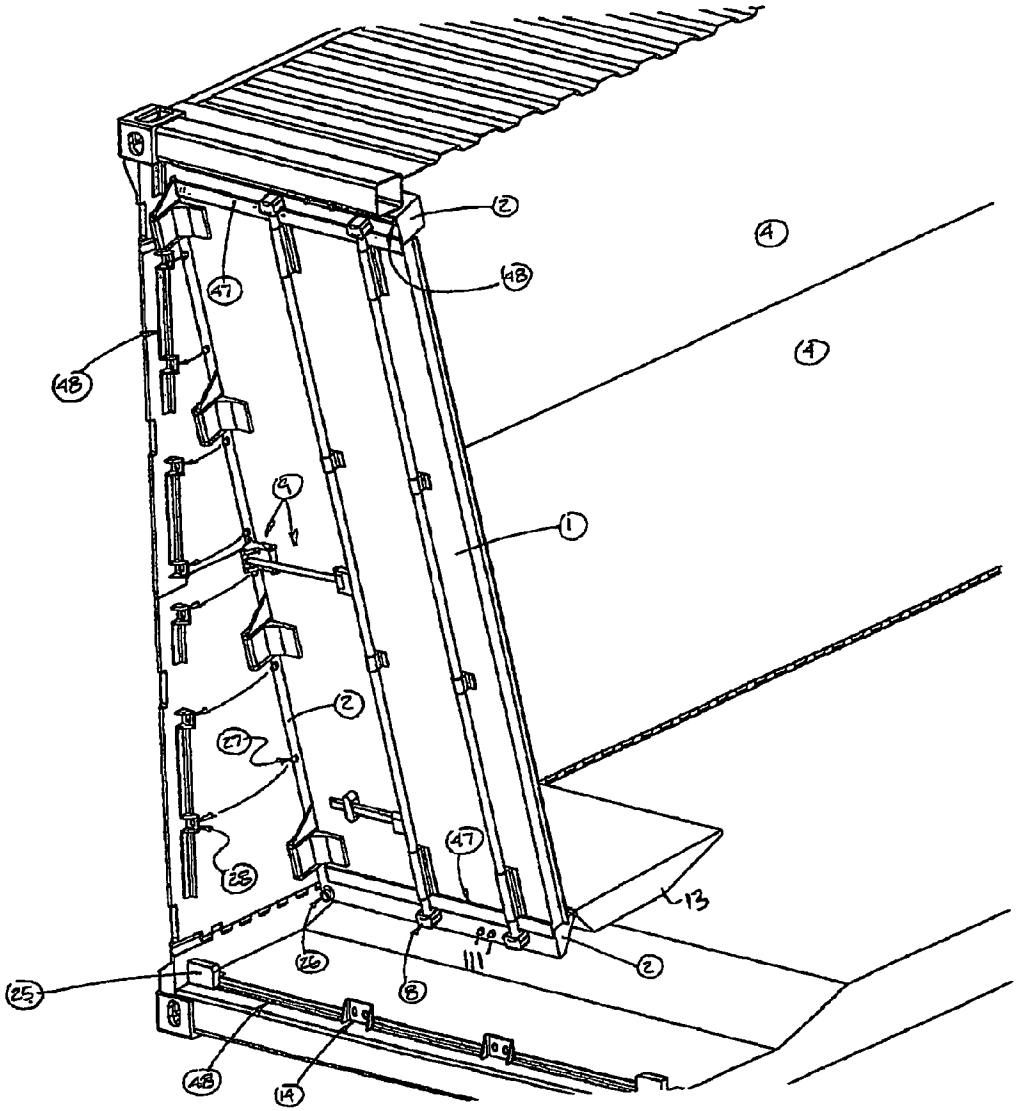
FIG. 8 is an elevated perspective view of the door frame and ramp assemblies as they are lifted toward the upper wall.

FIG. 8 shows door aperture frame 2 pushed further toward the roof under influence of the spreader. The ramp 13 is displaced from its recess in the floor, and begins to drag across the floor's upper surface as it is pushed by the door aperture frame. The side wall support pins 27 have disengaged from the side wall support brackets 28. The pins 111 can also be seen disengaged from down locks 14. In this view it can be seen that the door leaves 1 remain locked to the door aperture frame via door locks 8 and lashing assembly 9 as the container is folded. Conventional flat rubber seals 47 attached to the edges of the door leaves help to seal out water by covering the gaps between the leaves and the door aperture frame 2. A similar seal is attached to the right-hand door leaf to seal the vertical gap between the leaves on the container centerline. L-shaped rubber seals 48 of various lengths seal the gap between the outer perimeter of the door aperture frame 2 and the other components of the container. This type of seal is also used across the top edge of the front wall, and may be used on the sides of the front wall as well.

Figure 9:
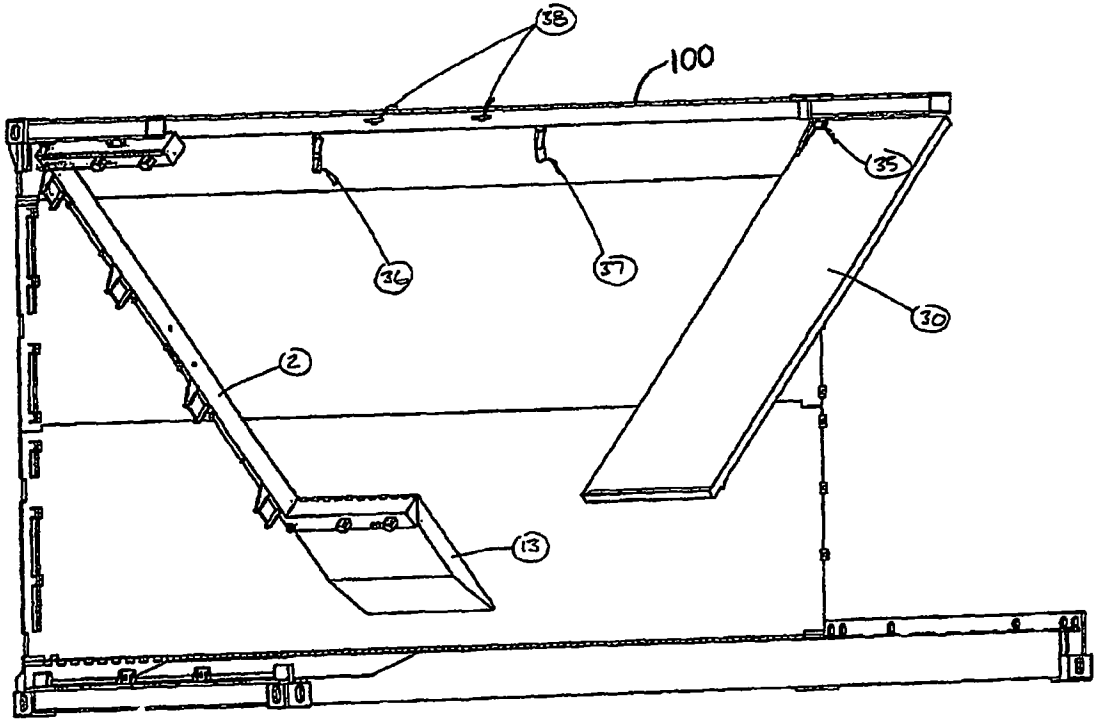
FIG. 9 is a side view, partially in cut-away, showing the door assembly and front wall being rotated toward the upper wall.

FIG. 9 illustrates how the front wall 30 folds into the roof in a similar manner to the door aperture frame 2. The door leaves are removed to more clearly show the door aperture frame 2. The front wall in most cases will not open for loading and unloading cargo, and does not contain door leaves. The front wall hinges on hinge pins 35 are similar to those on the door aperture frame 2, and are locked in position when the container is completely unfolded via down locks similar to those used to lock the door aperture frame in place. Ramp 13 has now pivoted clockwise into contact with the door aperture frame 2, which acts as a stop for the ramp 13. Door aperture frame up lock 36 serves to retain the door aperture frame 2 against the upper wall 100 when the container is folded. A similar up lock 37 serves to retain the front wall frame 30 against the upper wall when the container is folded. Various up stops 38 keep the door aperture frame 2, ramp 13 and front wall 30 from bouncing against the upper wall 100 when the container is folded.

Figure 10:
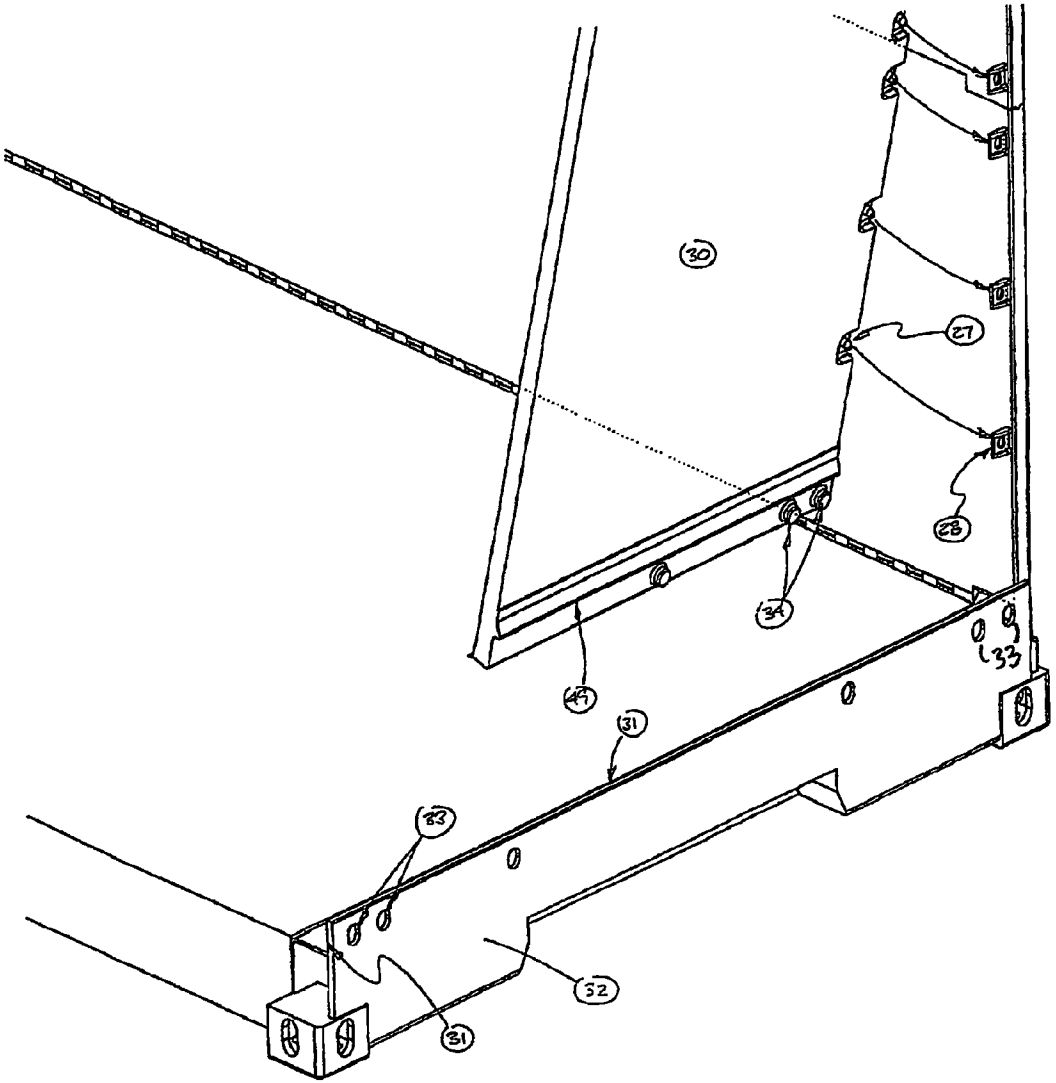
FIG. 10 is an elevated, perspective view of the lifting pins and lugs and alignment pins and brackets on the door and door frame assemblies.

FIG. 10 shows the vertical transverse flange 31 on the front sill 32, which acts as a down stop for the front wall 30. Lifting pins 34 integral with the front wall 30 engage lifting holes 33 in the flange 31 of front sill 32. These pins 34, along with the front wall hinge pins 35, form the path for tensile lifting loads between vertical pairs of corner fittings at the front end of the container. This view also shows the side wall support pins 27 disengaged from the side wall support brackets 28. Also shown is a seal 49 that serves to help seal out water primarily by resting above flange 31 and serving as a sort of overhanging roof.

Figure 11:
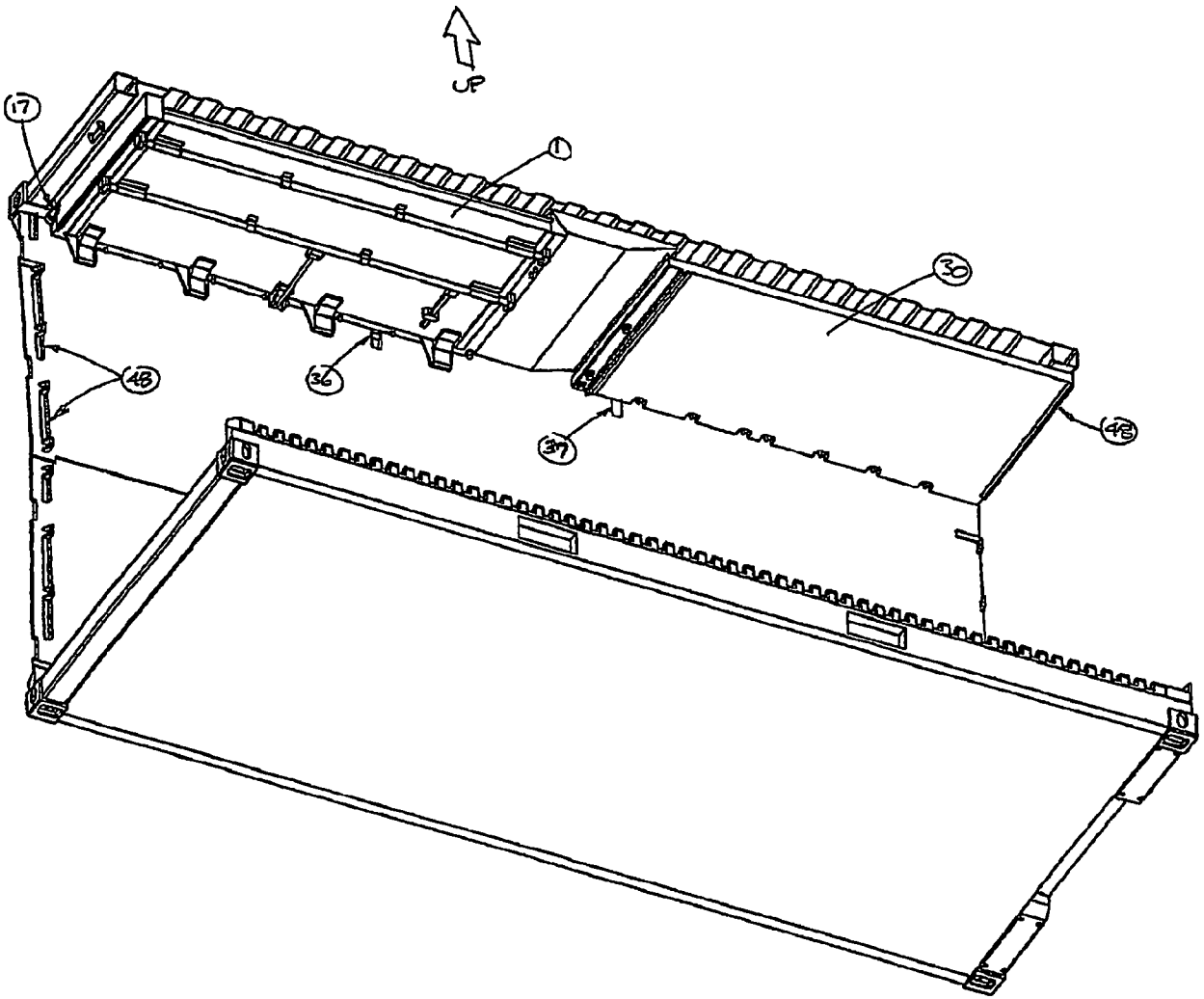
FIG. 11 is lowered perspective view looking upward into the container showing the attachment of the door assembly and front wall against the upper wall using up locks.

FIG. 11 is a perspective view looking up at the upper surface of the container with the door frame and front wall rotated into the locked position against the upper wall 100. The door aperture frame 2 carrying the door leaves 1 is locked against the upper wall 100 by the up lock 36 and the front wall 30 is locked by up lock 37.

Figure 12:
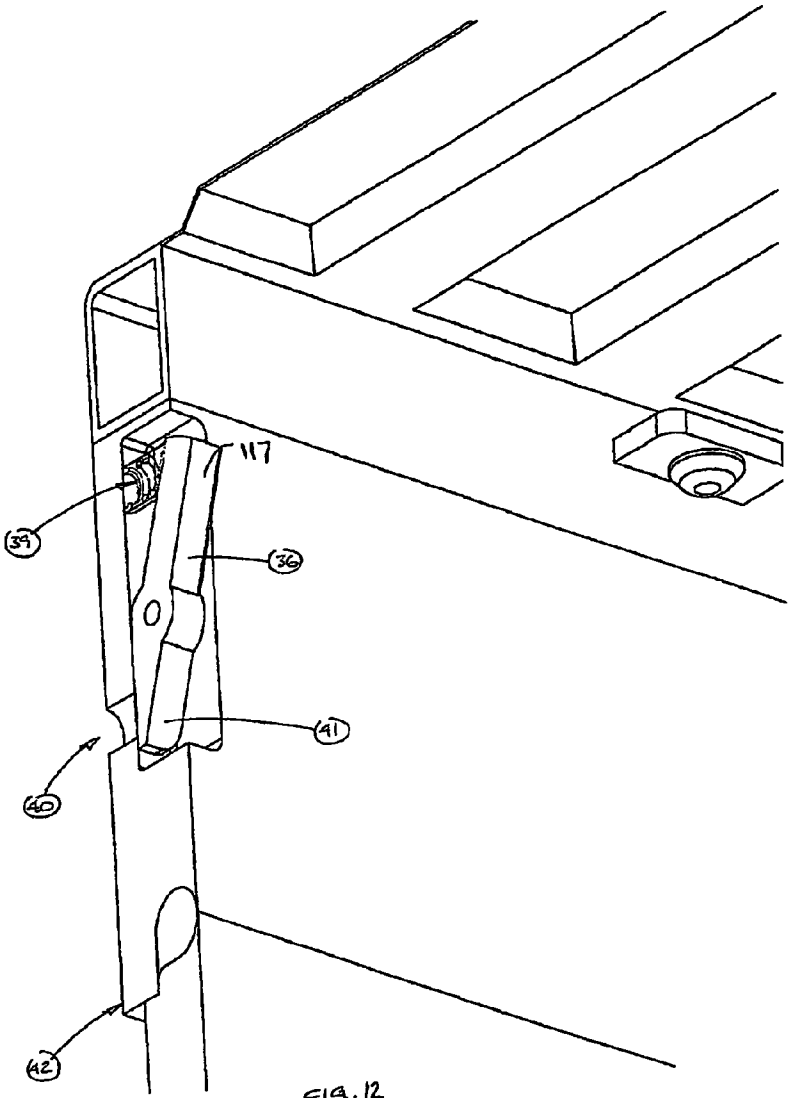
FIG. 12 is an enlarged, perspective of the up locks of FIG. 11.

FIG. 12 is a close-up sectional view of up lock 36. A spring 39 biases the up lock in the inboard direction as shown. The spring, as well as the inclined inboard face 117 of the up lock 36, allow the door aperture frame 2 to push the up lock 36 out of the way during the folding operation, so that the door aperture frame can move to its upper rest position. The lock 36 springs inboard again once the door aperture frame has passed, locking the door aperture frame 2 into place. When the container needs to be unfolded, a pin on the spreader apparatus passes through hole 40 and pushes on lever 41 of the up lock 36, causing the up lock to move outboard and allowing the door aperture frame 2 to pass in the opposite direction. A similar arrangement is used for the front wall.

Figure 13:
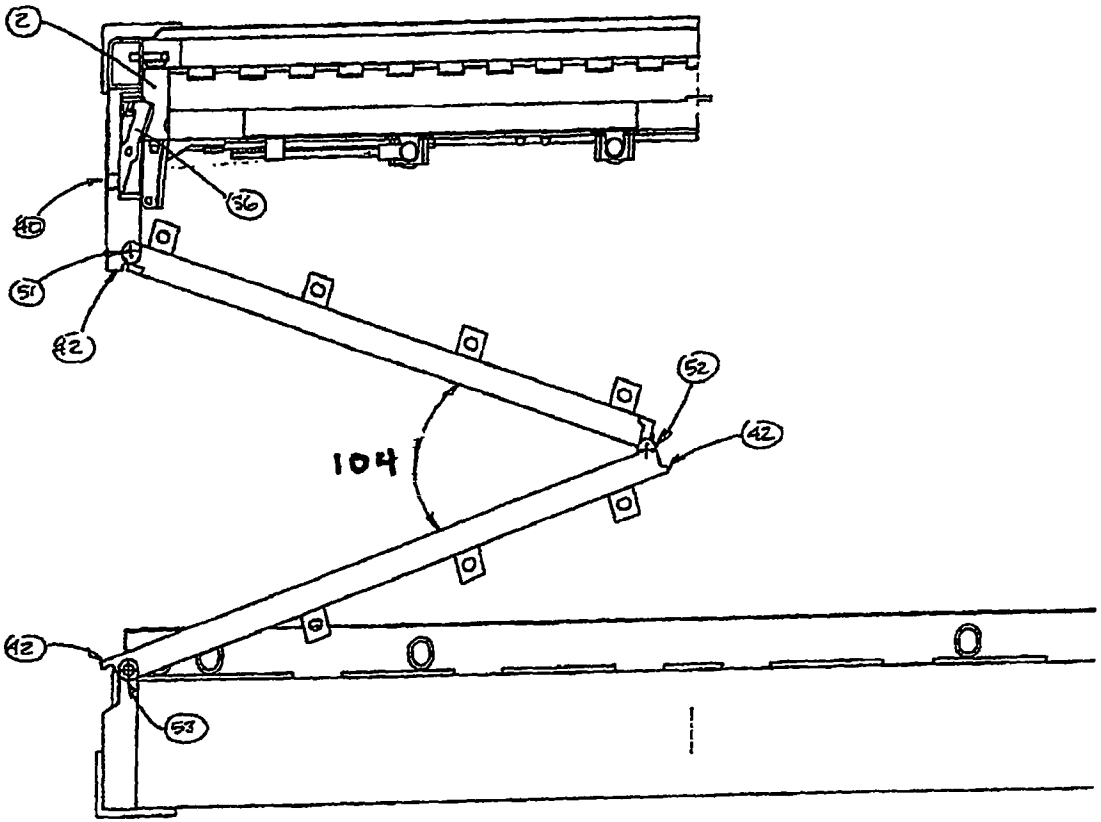
FIG. 13 is a side view of the side wall collapsing about its hinge assemblies.

FIG. 13 shows how the side walls 104 are hinged, allowing the container 99 to fold. Upper side wall hinge 51, mid side wall hinge 52, and lower side wall hinge 53 are positioned at respective junctures of the side wall 104. These hinges may be continuous "piano-type" hinges as shown in the drawings, or may be a series of shorter hinges. The hinges may be replaceable and may fasten with bolts. With the container resting on a supportive surface, the spreader apparatus begins to lower toward the ground. The door aperture frame 2 can be seen folded and locked into the roof by up lock 36. The hinges along the side walls are designed with flanges 42 that help to prevent water from entering the container by keeping the hinges covered.

Figure 14:
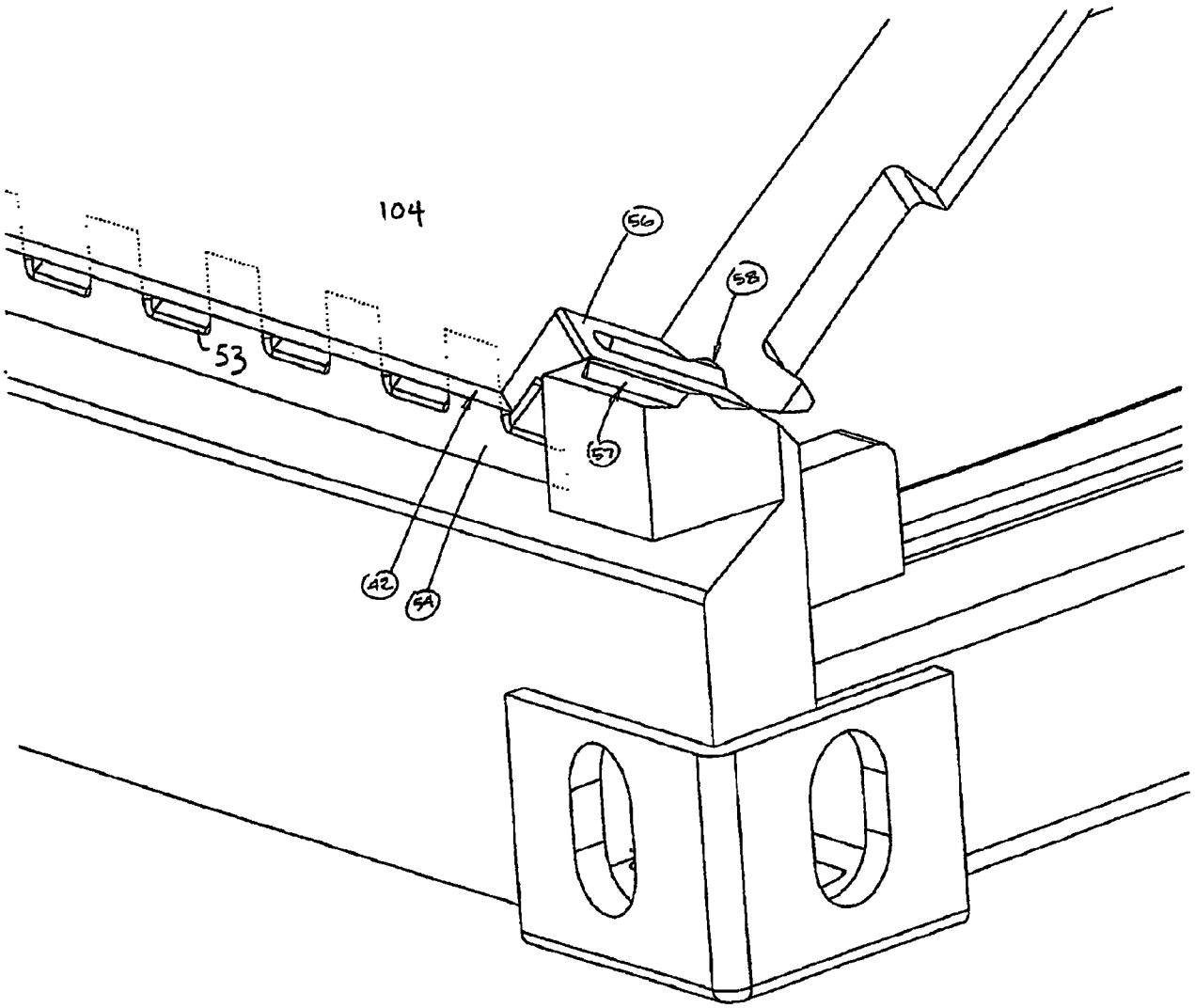
FIG. 14 is an enlarged, elevated perspective view of the alignment means of the support column.

FIG. 14 shows the container partially folded, revealing lower side wall hinge 53 of FIG. 13, including integral water sealing flange 42. This flange contacts surface 54 when the container is in the unfolded state, serving to cover the hinge and help keep water out of the container. This arrangement, with the flange 42 pointing down on the outboard side of the hinge, on the upper mating component, is typical of the side wall hinges 51 and 53 as seen in FIG. 13. Compression face 56, the exposed end of a compression column inside side wall 104, can be seen, as well as alignment features 57 and 58. It can be seen that the side wall hinge stops short of reaching the end of the wall, so as not to be involved with the compressive load path when the container is in the unfolded state. This is typical for all the side wall hinges, and at both front and rear ends of the container.

Figure 15:
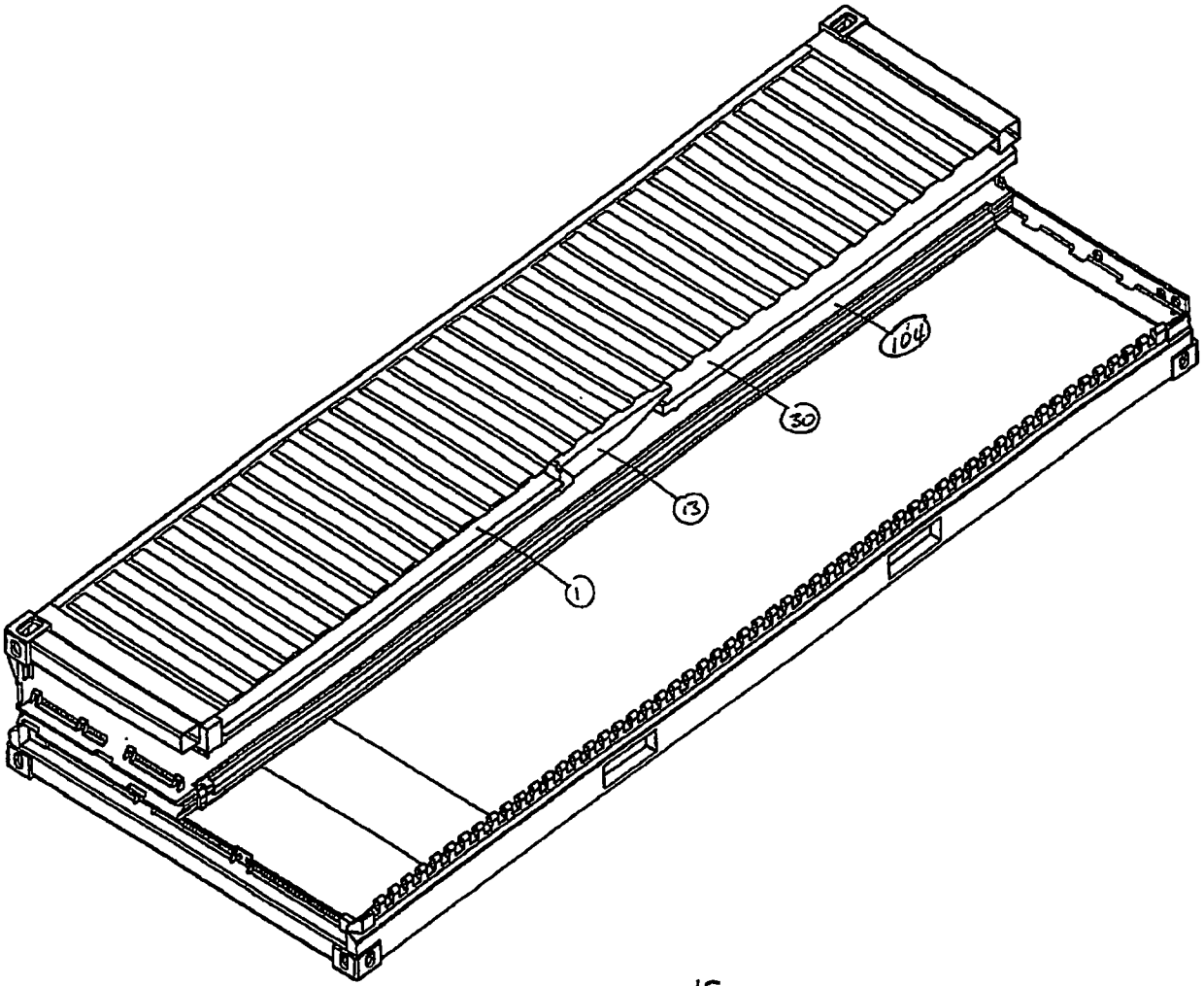
FIG. 15 is an elevated, perspective view of the side wall assembly fully collapsed.
Figure 11B:
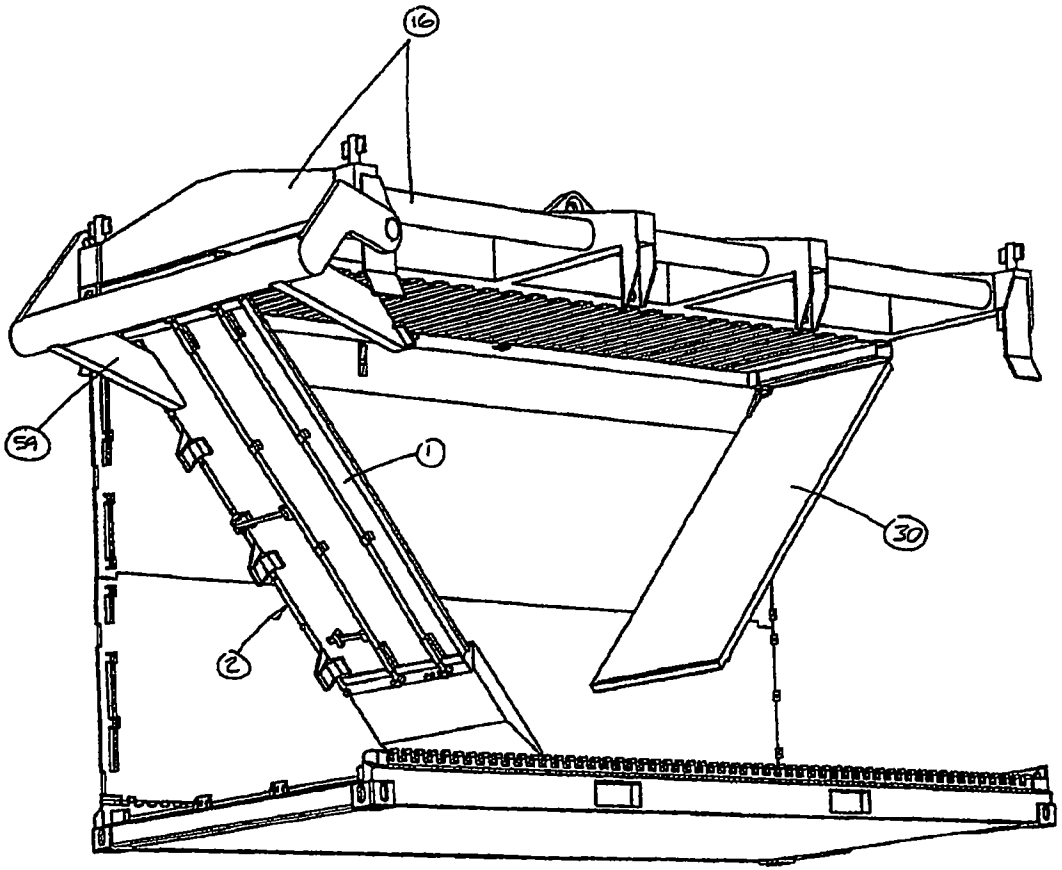

FIG. 15 shows the container 99 fully collapsed. The side walls 104 can be seen resting on the floor. FIG. 16 is a cut-away side view showing a catch 43 that holds ramp 13 down firmly when the container is unfolded. The catch is biased by a spring 45 against a stop 46, which is integral with the floor. The catch engages with pin 44, which is integral with the ramp. The shape of the catch and the presence of the spring allow the catch to move out of the way, so as not to interfere with the movement of the ramp as it find its way into the recess in the floor. Engagement of pin 44 does not require that the pin 44 move laterally or diagonally into engagement with the catch 43. It can just as easily engage vertically, should the ramp not drop into place as expected.

FIG. 16 shows the specially-designed spreader apparatus 59 engaged with the container via the upper corner fittings, which are not visible. An arm 60 on the spreader is seen as it pushes the door aperture frame 2 (carrying the door leaves) and the front wall 30 against the upper wall. The specially-designed spreader also serves to unlock the door aperture frame 2 and front wall 30 from their extreme positions.

The construction of the container provides for a tensile load path at the rear end of the container when a loaded container is lifted by the spreader apparatus. Load is carried from the upper corner fitting 12, through the side rail of the roof, out to the hole in the side wall that receives the door aperture frame hinge pin, through the pin 17, down the door aperture frame 2, through the lifting pin of the door aperture frame, to the lifting lug 25, which is welded the top of the lower corner fitting 12. The side wall hinges are isolated from load.

There is also a compressive load path at the rear end of the container when other containers are stacked on top. Load is carried from the upper corner fitting 12, through the side rail of the roof, through the vertical compression columns built into the ends of the side walls, and through the side rail of the floor, that is welded to the lower corner fitting 12. The side wall hinges are isolated from load. Because the side walls carry the bulk of the vertical compressive loads, and because the side wall hinges promote buckling of the load path, it is critical to maintain the side walls in proper alignment with the load path. The side wall support pins 27 and side wall support brackets 28 accomplish this by tying the side walls 104 into the vertical member of the door aperture frame 2. The vertical member of the door aperture frame should remain straight (viewed from the rear), since it is not exposed to compressive loads, and since it is tied into the door leaves 1 via lashing assembly 9. The holes in side wall support brackets 28 that receive the side wall support pins 27 may be slotted vertically to help to insure that compressive loads are not introduced into the door aperture frame.

There is also a tensile load path at front end of the container. Load is carried from the upper corner fitting 12, through the side rail of the roof, out to the hole in side wall that receives the front wall hinge pin, through the pin 35, down the front wall 30, through the lifting pin 34 of the front wall, and through the flange 31 of front sill 32 that is welded to the top of the lower corner fitting 12. The side wall hinges are isolated from the tensile load.

The compressive load path at the front end of the container is described as follows. Load is carried from the upper corner fitting 12, through the side rail of the roof, through the vertical compression columns built into the ends of the side walls, and through the side rail of the floor, which is welded to the lower corner fitting 12. The side wall hinges are isolated from the compressive load. The side wall support pins 27 and side wall support brackets 28 tie the side walls 104 into the front wall 30 to stabilize the side walls. The front wall 30 should remain straight since it is not exposed to compressive loads. The holes in side wall support brackets 28 that receive the side wall support pins 27 may be slotted vertically to help to insure that compressive loads are not introduced into the front wall.

Figure 17:
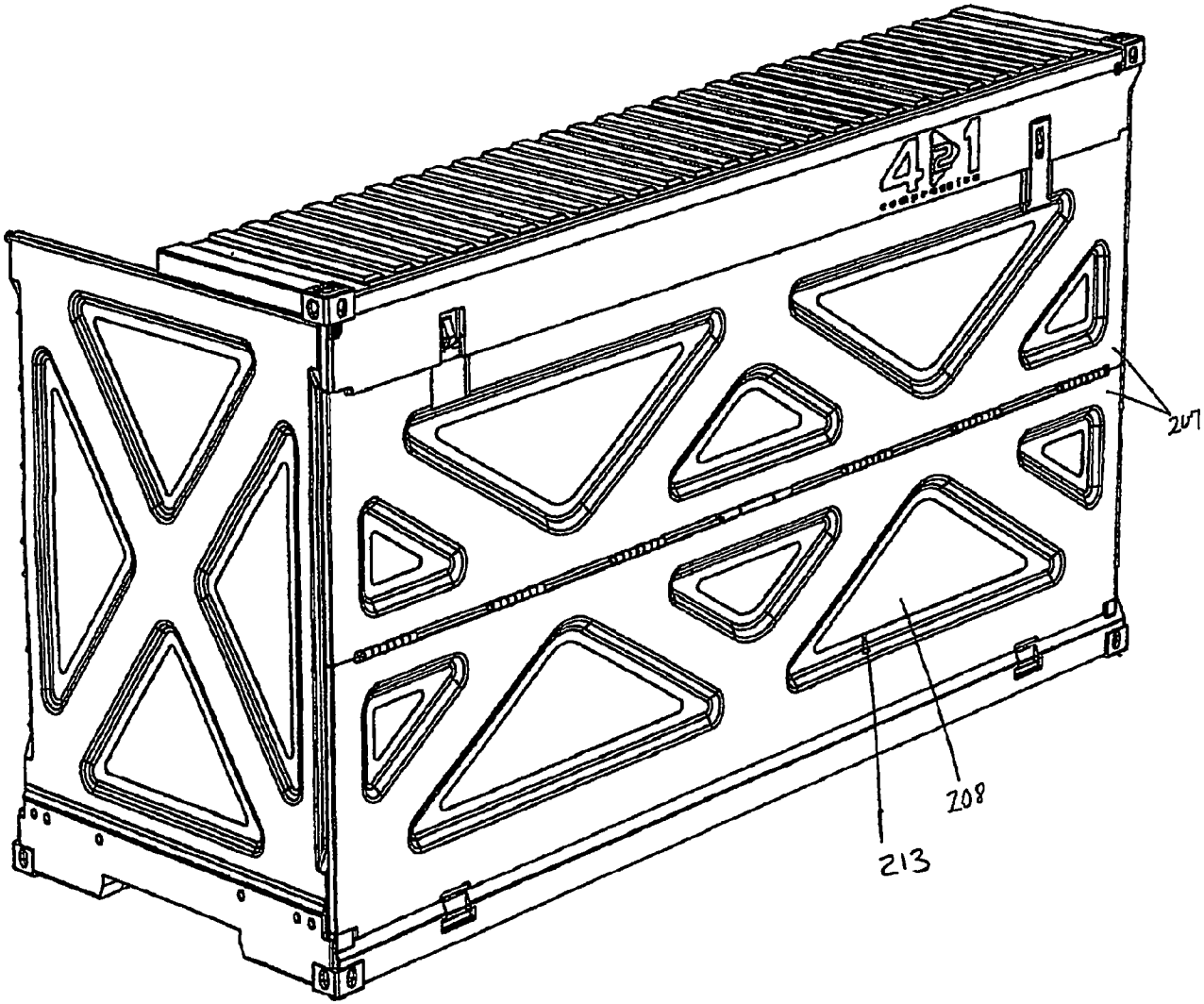
FIG. 17 is a perspective view of a preferred embodiment of the present invention showing an improved composite construction light weight panel.
Figure 18:
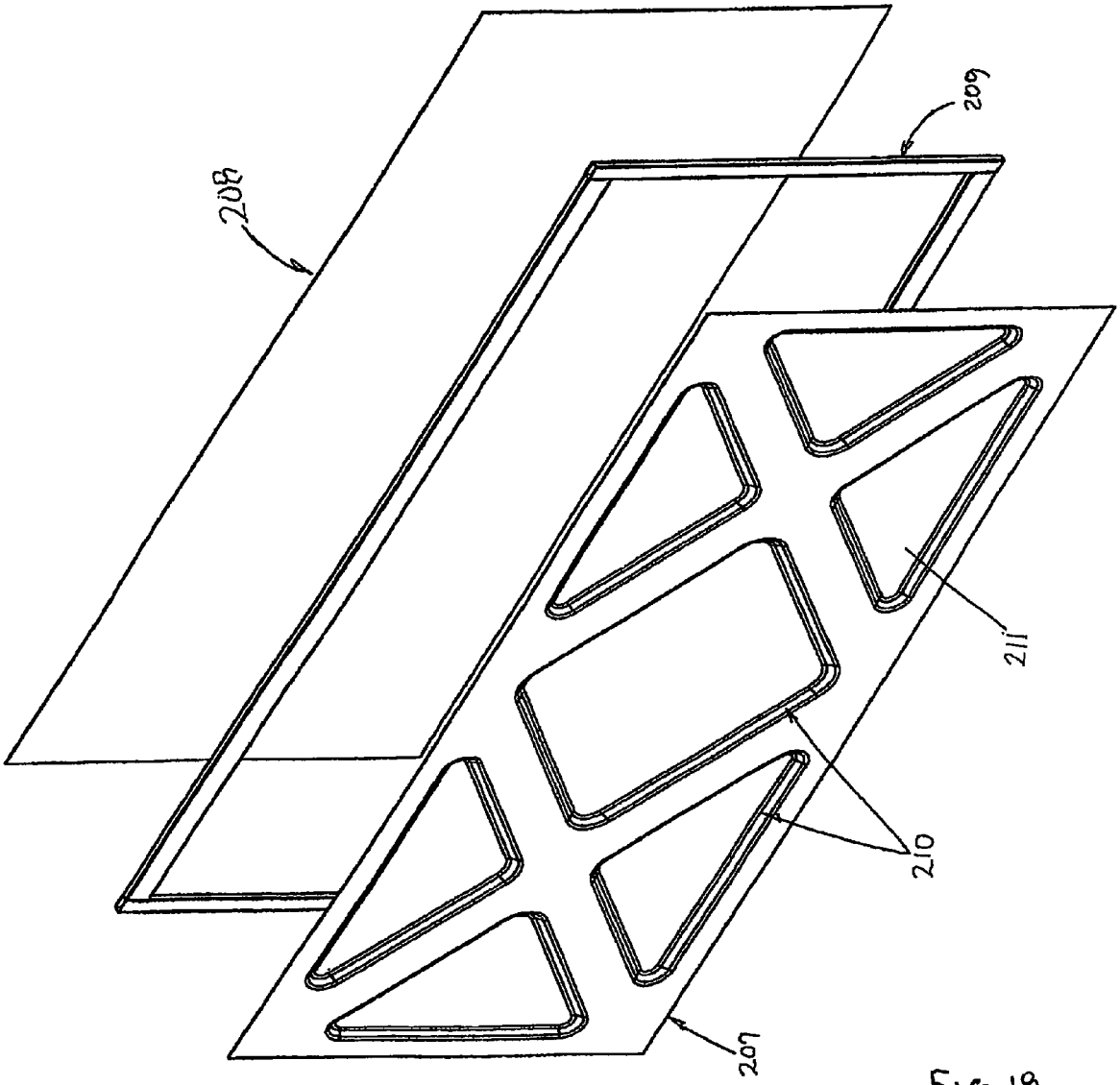
FIG. 18 is an exploded view of the improved panel of FIG. 17.

FIG. 17 illustrates a preferred embodiment of the present invention with a modified panel for the side walls 104 and end wall 30. The side wall 104 includes upper and lower sections that fold along the hinge as previously described. FIG. 18 illustrates an exploded view of the panel of the proposed construction. Although the following description of the new panel preferably uses steel for all of the various parts, and fusion of the various parts by welding, other materials such as aluminum and composites (fiberglass), and other methods of fusion such as riveting and bonding may be substituted in any combination.

The outer skin 207 which serves as the exterior face of the wall structure is a pressing formed from steel sheet. The various pressed recesses 211 result in the formation of inclined faces which serve as structural stiffening ribs 210. The inner skin 208 which serves as the interior face of the wall structure is a plain steel sheet without contour. Outer skin 207 and inner skin 208 are welded to perimeter frame 209 along their outer edges. Perimeter frame 209 is a weldment of various steel tubes or channels. Outer skin 207 and inner skin 208 contact, and are welded to each other in the areas of the pressed recesses 211.

Figure 19:
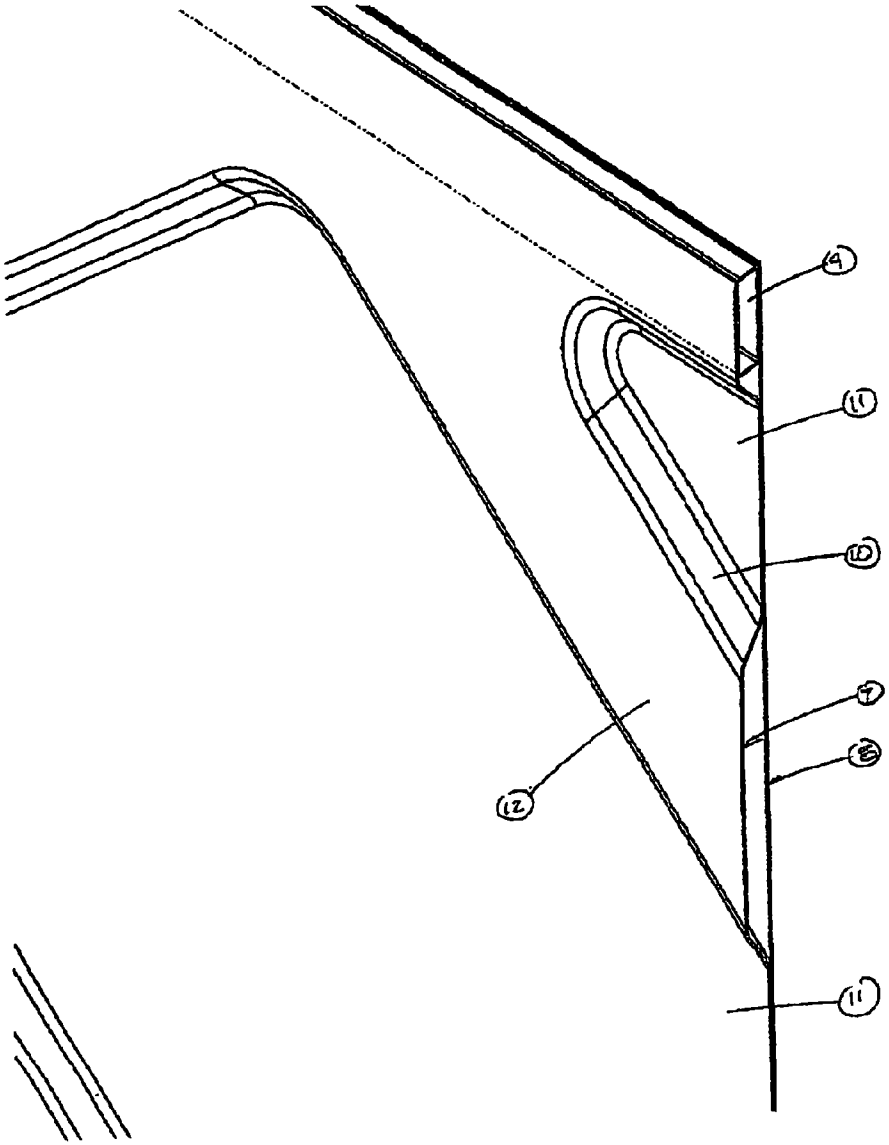
FIG. 19 is an enlarged, cut-away portion of the panel of FIG. 17.

FIG. 19 is a cut-away view of the panel, showing how the fusion of outer skin 207 and inner skin 208 result in the formation of structural box members 212 which impart great strength to the wall assembly and eliminate the necessity of incorporating separate internal framework or core structure. The outer skin 207 in the areas of the pressed recesses 211 can be removed to create weight reducing holes that serve to reduce container weight, facilitate weld inspection, and allow adhesive to escape in the case of fusion via bonding.

The pressed recesses 211 can take other forms such as round dimples, squares, stripes, etc. in repeating geometric patterns of various arrangements, instead of triangular recesses as described, eliminating the need for the incorporation of a separate core material or separate ribs to tie the skins together. The outer skin meets, and is fused to, the flat and smooth inner skin via welding in each case.

Figure 20:
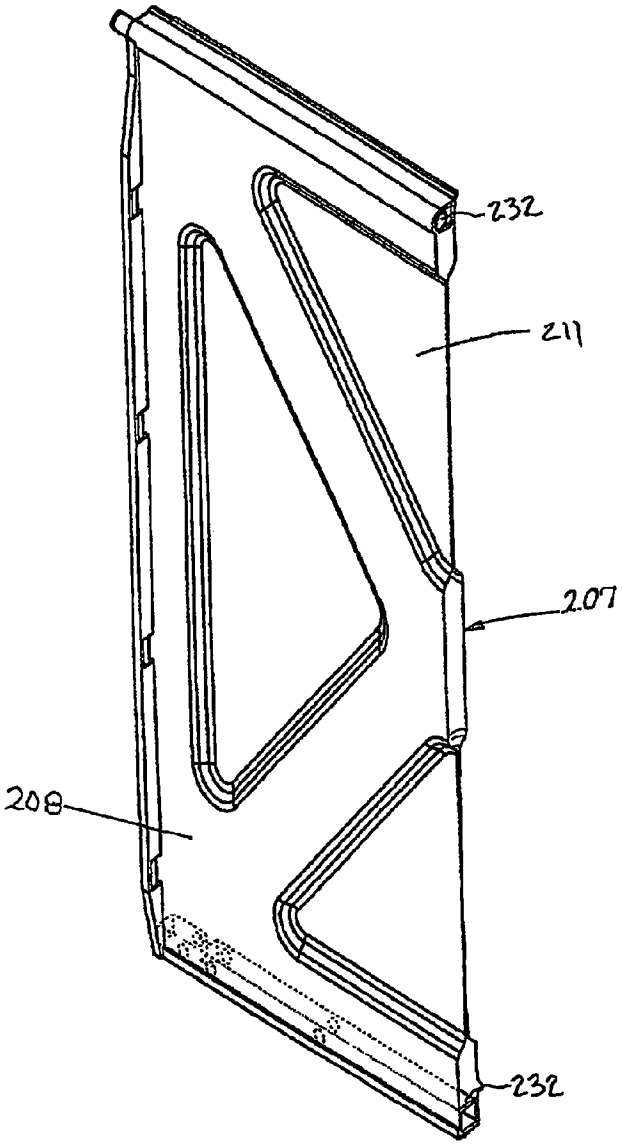
FIG. 20 is an elevated, perspective view of the panel in cut-away showing reinforcing bars in the channels.

FIG. 20 shows a variation of the improved panel of the invention used in the construction of a front wall. The panel is sectioned on its centerline to reveal the contours of the inner skin 208 and outer skin 207. In this case, both face skins incorporate pressed recesses 211 which meet and are fused together, again, eliminating the need for the incorporation of a separate core material or separate ribs. This version is appropriately used where walls are especially thick or where smooth faces are not deemed necessary. The panels are also reinforced with strengthening members 232 within the channel portions that serve to make the panel more rigid.

Figure 21:
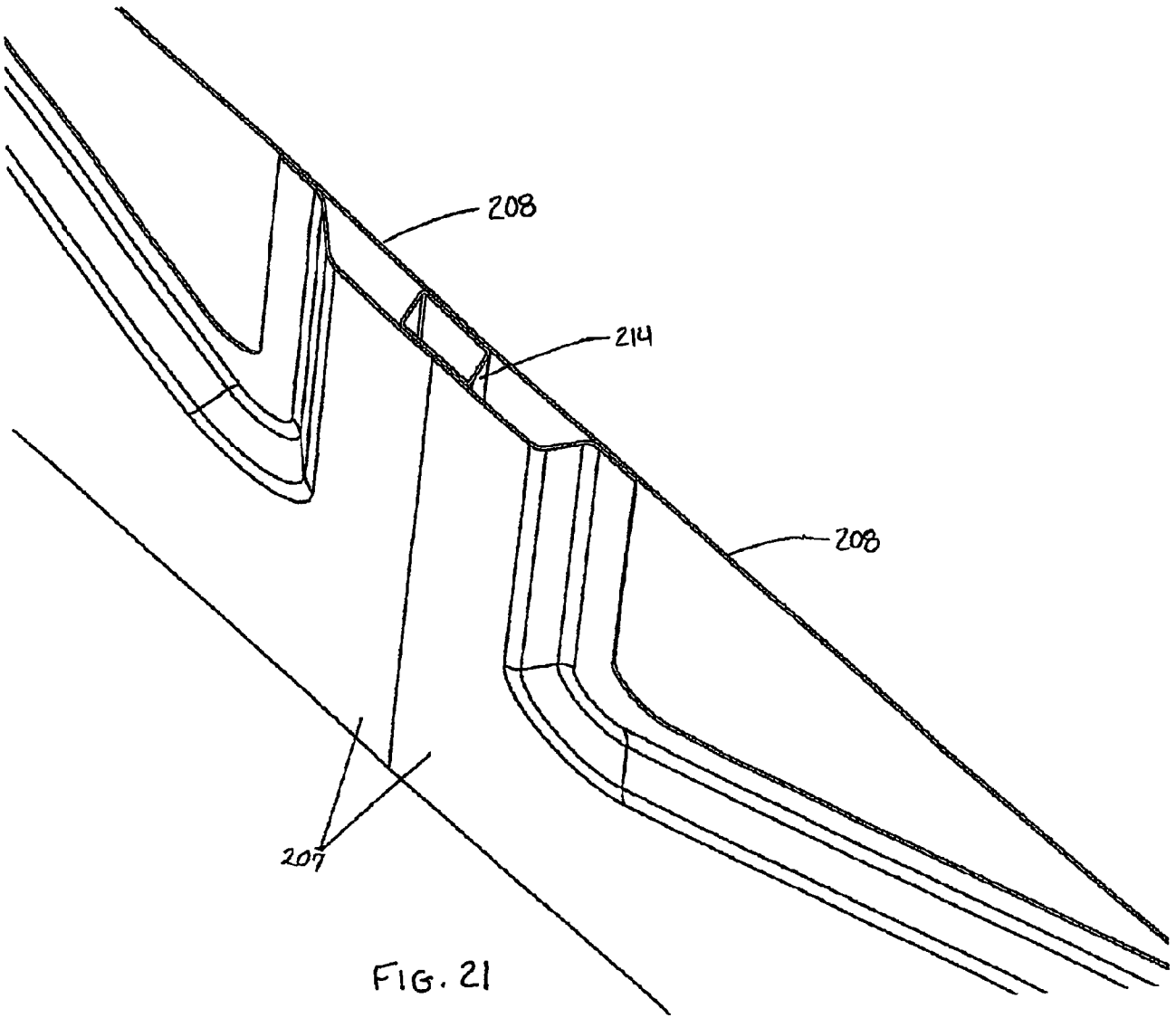
FIG. 21 is an enlarged, elevated perspective view of the panel of FIG. 17 showing vertical members disposed within the vertical channels of the panel.

FIG. 21 illustrates vertical members 214 between the outer skin panels 207 and inner skin panels 208. Outer skin panels 207 are shown butted against each other, but may overlap as an option Inner panels 208 are shown butted against each other, but also may overlap as an option.

The foregoing are illustrative of the concepts embodied by the present invention, although other embodiments would be known to one of ordinary skill in the art and the invention should be deemed to include such embodiments. Accordingly, the invention should not be limited by the preceding descriptions, but rather only by the words in the appended claims presented below.

We claim:

1. A collapsible cargo container having an upper wall, a floor, first and second side walls, and first and second end walls, and where said container can assume an unfolded position and a collapsed position, comprising:

an upper wall having an exterior surface and an interior surface, and including releasable catches on said interior surface for retaining first and second pivoting end walls;

a first end wall pivotable against said interior surface of said upper wall and engagable with one of said releasable catches to secure said first end wall adjacent said upper wall, and a second end wall pivotable against said interior surface of said upper wall and engageable with one of said releasable catches to secure said second end wall adjacent said upper wall, and wherein the first end wall includes a door frame and at least one pivoting door;

first and second side walls, each side wall having an upper section and a lower section pivotably connected at hinges and collapsible along said hinges into a folded configuration when said first and second end walls are engaged with said releasable catches;

a ramp coupled to said door frame, said ramp pivoting with said door frame and secured by one of said releasable catches when said first end wall is secured against said upper wall; and wherein said door frame on the first end wall includes lifting pins that cooperates with corresponding lifting lugs to form a path for tensile lifting loads between vertical pairs of corner fittings; and wherein said ramp is wedge shaped and automatically moves out of its recess as it is pushed by the door frame when said container transitions to the collapsed position.

2. The collapsible cargo container of claim 1 wherein said first and second side walls include a first hinge extending horizontally at a first height positioned below said releasable catches, a second hinge extending horizontally along a mid-length portion, and a third hinge at approximately the same distance below said second hinge as a distance between said first and second hinges.

3. The collapsible cargo container of claim 2 wherein said upper section of said first and second side walls lie parallel and over said respective lower sections of said first and second side walls when said container is collapsed.

4. The collapsible cargo container of claim 1 including releasable spring loaded down locks for retaining the door frame in place in the unfolded position.

* * * * *